US007240739B2

(12) United States Patent
Schoonderbeek et al.

(10) Patent No.: US 7,240,739 B2
(45) Date of Patent: Jul. 10, 2007

(54) WELL FLUID CONTROL

(75) Inventors: Gerhard Schoonderbeek, Woking (GB); Laurent Alteirac, Houston, TX (US); Jeremy P. Walker, Saint Germain en Laye (FR); Rodney J. Wetzel, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 357 days.

(21) Appl. No.: 10/710,807

(22) Filed: Aug. 4, 2004

(65) Prior Publication Data

US 2006/0027377 A1 Feb. 9, 2006

(51) Int. Cl.
*E21B 34/06* (2006.01)
*E21B 43/08* (2006.01)
*E21B 43/32* (2006.01)

(52) U.S. Cl. ..... 166/386; 166/325; 166/227

(58) Field of Classification Search ..... 166/227, 166/386, 325–329
See application file for complete search history.

(56) References Cited

U.S. PATENT DOCUMENTS 2,217,305 A * 10/1940 Bryan ..... 417/117
2,307,991 A * 1/1943 Burke ..... 417/143
2,602,516 A * 7/1952 Gray ..... 175/65
2,781,099 A 2/1957 Chesnut
2,897,897 A * 8/1959 Breukelman ..... 166/120
2,981,334 A 4/1961 Powell
3,136,359 A 6/1964 Graham
3,292,703 A 12/1966 Weber
3,362,477 A 1/1968 Brandt
3,633,627 A 1/1972 Perrott et al.
3,881,550 A 5/1975 Barry
3,908,380 A 9/1975 Lobach
3,910,050 A 10/1975 Matthews et al.
3,938,334 A 2/1976 Matthews (Continued)

FOREIGN PATENT DOCUMENTS

WO WO 03/052238 A1 6/2003

(Continued)

OTHER PUBLICATIONS

F.J. Santarelli, Eiliv Skomedal, Per Markestad, H.I. Berge, Havard Nasvig; "Sand Production on Water Injectors: How Bad Can It Get?"; SPE Drill & Completion, vol. 15, No. 2, Jun. 2000, pp. 132-139.

(Continued)

*Primary Examiner*—Kenneth Thompson
(74) *Attorney, Agent, or Firm*—Fred G. Pruner; Bryan P. Galloway; Tim Currington

(57) ABSTRACT

A well conduit that has an aperture for communicating with a target reservoir and a one-way valve in the aperture may be used in injection and production wells. Other devices, systems, methods, and associated uses are also included in the present invention. For example, the conduit housing the valves may be used as a base pipe for a sand screen. It is emphasized that this abstract is provided to comply with the rules requiring an abstract, which will allow a searcher or other reader to quickly ascertain the subject matter of the technical disclosure. It is submitted with the understanding that it will not be used to interpret or limit the scope or meaning of the claims.

8 Claims, 4 Drawing Sheets

U.S. PATENT DOCUMENTS

| | | | | | |
|---|---|---|---|---|---|
| 3,945,435 | A | | 3/1976 | Barry | |
| 4,143,712 | A | | 3/1979 | James et al. | |
| 4,183,404 | A | | 1/1980 | James et al. | |
| 4,189,003 | A | | 2/1980 | James et al. | |
| 4,258,788 | A | * | 3/1981 | Patton et al. | 166/185 |
| 4,399,871 | A | | 8/1983 | Adkins et al. | |
| 4,463,804 | A | | 8/1984 | Rooney et al. | |
| 4,484,625 | A | * | 11/1984 | Barbee, Jr. | 166/185 |
| 4,551,154 | A | | 11/1985 | Malcosky et al. | |
| 4,633,943 | A | * | 1/1987 | Zunkel | 166/51 |
| RE32,441 | E | | 6/1987 | Higgins et al. | |
| 4,690,689 | A | | 9/1987 | Malcosky et al. | |
| 4,825,944 | A | | 5/1989 | Mays | |
| H635 | H | | 6/1989 | Johnson et al. | |
| 4,844,169 | A | | 7/1989 | Sloat | |
| 4,901,796 | A | | 2/1990 | Drnevich | |
| 4,919,206 | A | | 4/1990 | Freeman et al. | |
| 4,945,947 | A | | 8/1990 | Westra et al. | |
| 5,020,595 | A | | 6/1991 | Van Slyke | |
| 5,027,896 | A | | 7/1991 | Anderson | |
| 5,055,030 | A | | 10/1991 | Schirmer | |
| 5,127,474 | A | * | 7/1992 | Schroeder et al. | 166/278 |
| 5,188,172 | A | | 2/1993 | Blount et al. | |
| 5,209,298 | A | | 5/1993 | Ayres | |
| 5,209,299 | A | | 5/1993 | Ayres | |
| 5,209,300 | A | | 5/1993 | Ayres | |
| 5,209,301 | A | | 5/1993 | Ayres | |
| 5,333,654 | A | * | 8/1994 | Faeth | 141/1 |
| 5,335,732 | A | | 8/1994 | McIntyre | |
| 5,341,874 | A | | 8/1994 | Wilson | |
| 5,400,430 | A | | 3/1995 | Nenniger | |
| 5,425,416 | A | | 6/1995 | Hammeke et al. | |
| 5,445,225 | A | | 8/1995 | Wiggins, Sr. | |
| 5,501,275 | A | | 3/1996 | Card et al. | |
| 5,706,891 | A | | 1/1998 | Schraub | |
| 5,775,442 | A | | 7/1998 | Speed | |
| 5,829,520 | A | | 11/1998 | Johnson | |
| 5,979,553 | A | | 11/1999 | Brink | |
| 6,002,063 | A | | 12/1999 | Bilak et al. | |
| 6,142,224 | A | | 11/2000 | Stuebinger et al. | |
| 6,167,965 | B1 | | 1/2001 | Bearden et al. | |
| 6,172,011 | B1 | | 1/2001 | Card et al. | |
| 6,173,768 | B1 | | 1/2001 | Watson | |
| 6,196,314 | B1 | | 3/2001 | Chen | |
| 6,273,195 | B1 | | 8/2001 | Hauck et al. | |
| 6,354,378 | B1 | | 3/2002 | Patel | |
| 6,464,005 | B1 | | 10/2002 | Ellis | |
| 6,672,387 | B2 | | 1/2004 | Brady et al. | |
| 2003/0037924 | A1 | | 2/2003 | Ellis | |
| 2003/0159828 | A1 | | 8/2003 | Howard et al. | |
| 2003/0221827 | A1 | | 12/2003 | Brady et al. | |
| 2005/0098324 | A1 | * | 5/2005 | Gano | 166/384 |

FOREIGN PATENT DOCUMENTS

| | | |
|---|---|---|
| WO | WO 03/104611 A1 | 12/2003 |

OTHER PUBLICATIONS

Style BU Bushing Valve; Check-All Valve Mfg. Co.; catalog, House Series; Oct. 2003.

Style SSI Straight-Sided Insert; Check-All Valve Mfg. Co.; catalog, Insert Series, Straight Sided Insert; Oct. 2003.

Style UIV Union Insert Valve: Check-All Valve Mfg. Co.; catalog, Insert Series, Union Insert; Oct. 2003.

Precision Engineered Check Valves—Tilt Seat/Non Spring Assisted Valve, Severe Service, Extended Face-to-Face; HyGrade Valve, Inc.; internet catalog: http://www.hy-grade.com/optional_features.html; Jul. 2004.

Completion: Self Piloting Injection Valve (SIV); Weatherford; internet catalog: http://www.weatherford,com/weatherford/groups/public/documents/completion/cfcs_www006412...; Jun. 2004.

* cited by examiner

WELL FLUID CONTROL

BACKGROUND OF INVENTION

The present invention relates to the field of flow control in a well. More specifically, the invention relates to a device and method for controlling flow in a well using valves mounted within apertures in a well conduit as well as related systems, methods, and devices.

SUMMARY OF INVENTION

One aspect of the present invention is a well flow control device comprising a conduit having an aperture for communicating with a target reservoir and a one-way valve in the aperture. Other devices, systems, methods, and associated uses are also included in the present invention.

BRIEF DESCRIPTION OF DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

The present invention relates to various apparatuses, systems and methods for controlling fluid flow in a well. One aspect of the present invention relates to a conduit having an aperture for communicating with a target reservoir and a one-way valve in the aperture. Other aspects of the present invention, which are further explained below, relate to improving injection well performance using valves, preventing cross-flow in multizone and multilateral completions, and other methods and apparatuses for controlling fluid flow in a well.

Figure 1:
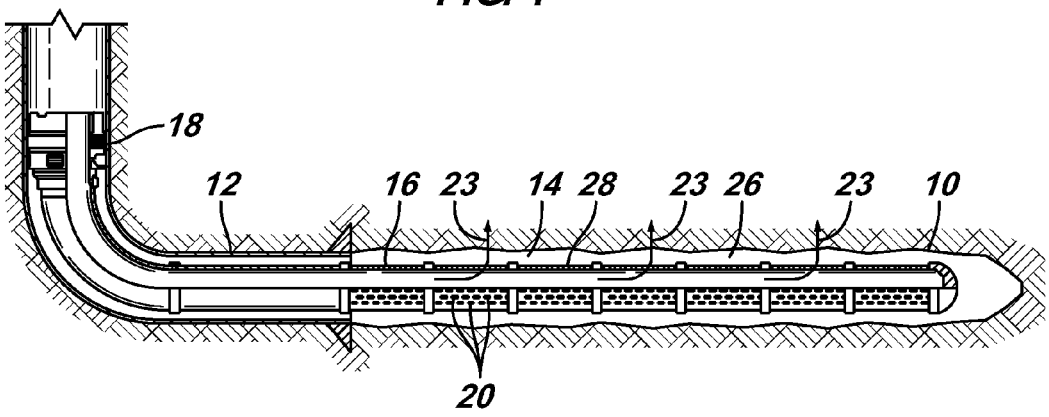
FIG. 1 illustrates an embodiment of the present invention in an injection well in which the conduit has a plurality of one-way valves mounted thereto.

As an example, FIG. 1 illustrates a well 10 having a cased section 12 and an open hole section 14. A conduit 16, or liner, extends from a packer 18 positioned in the cased section 12 downward into the open hole section 14. At least a portion of the conduit 16 is perforated to define multiple orifices or apertures 20 therein. Mounted within each of the apertures 20 is a one-way valve or check valve 22. The check valve 22 may take a variety of forms. However, the one-way valve 22 acts to allow flow in one direction and restrict or limit flow in an opposite direction. Depending upon the application and aperture size and other factors, some of the apertures 20 may omit valves 22, for example, if some bidirectional flow is acceptable.

The arrows 23 in FIG. 1 illustrate the direction of flow in an injection application. In an injection application, fluid is injected into a well 10. For example, a common practice used to increase recovery of oil from a reservoir is water-flooding. Water is injected into the reservoir through an injection well 10 as a nearby producing well produces oil from the formation. The goal is to maintain reservoir pressure and to generate a sweep effect pushing the oil using the injected water. One problem often encountered in injection applications occurs when injected fluid flows back into the well 10 or when cross-flow occurs. Another problem occurs when an inline valve or a pump is shut suddenly. When this happens an over pressure wave is generated creating a water hammer. This wave, or water hammer, propagates downhole and "liquefies" the poorly consolidated sand of the formation. Each of these problems can create a sanding issue in which sand enters the well 10, progressively plugging the well 10 and requiring expensive cleaning operations. Traditionally, this problem has been addressed with standard sand control methods, such as sand screens, gravel packs, and expandable sand screens. However, by preventing the flow of fluids back into the conduit 16, the present invention prevents sanding and acts as a dampener in the water hammer scenario reducing the water hammer affect. Thus, one aspect of the invention is a method to dampen a wave by limiting the flow of fluid into a well 10 with valves 22 positioned in the conduit wall that respond to the flow of fluid (e.g., like a check valve 22).

The check valve(s) 22 in the conduit 16 allows fluid to flow from an interior 24 of the conduit 16 to its exterior 26 and, thus, into the target reservoir. However, the valve(s) 22 limits or prevents flow in the opposite direction, from the conduit exterior 26 to its interior 24.

Figure 2:
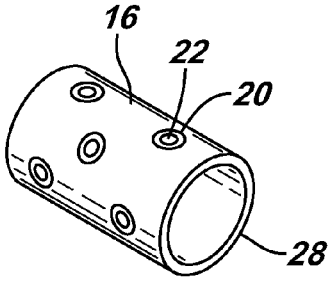
FIG. 2 illustrates a conduit section having valves mounted in the wall thereof.

FIG. 2 illustrates a conduit 16 or tubing for use in a well 10. The conduit 16 has substantially radial apertures 20 extending through its wall 28. Valves 22 are mounted in each of the apertures 20 and are adapted to limit or prevent flow therethrough. For example, in the injection example described above, the valves 22 could be one-way check valves that allow flow from the conduit 16 only (or at least limit inward flow). In other applications, the valves 22 may limit flow in the opposite direction (i.e., limit flow from the tubing). The valve 22 may take a variety of forms and may be mounted to the conduit 16 in a variety of ways. For example, the valve 22 may be mounted to the tubing by threaded connection, welding, interference fit, friction, detents, snap rings, or by any other connection technique. The valves 22 shown in the figure are generally flush with the exterior 26 of the wall 28, although they could extend from the wall 28 without departing from the scope of the present invention.

Figure 3:
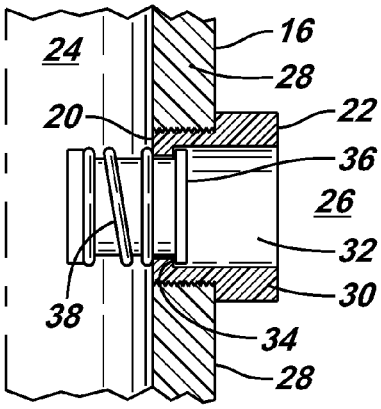

FIG. 3 illustrates one type of valve 22. The valve 22 is threaded into an opening (aperture 20) in the conduit wall 28 and extends from the wall 28. The valve 22 has a housing 30, attached to the conduit wall 28, that defines an interior 32 and a valve seat 34. A valve member 36, such as a poppet, in the housing 30 is biased to a closed position by a spring 38. When the valve 22 is exposed to sufficient opening fluid pressure, the valve member 36 moves to an open position, off-seat to allow fluid flow through the valve 22. The valve 22 shown in FIG. 3 provides for flow from an interior 24 of the well conduit 16 to an exterior 26 of the conduit 16, but prevents or restricts flow in the opposite direction (as in an injection well 10).

Figure 4:
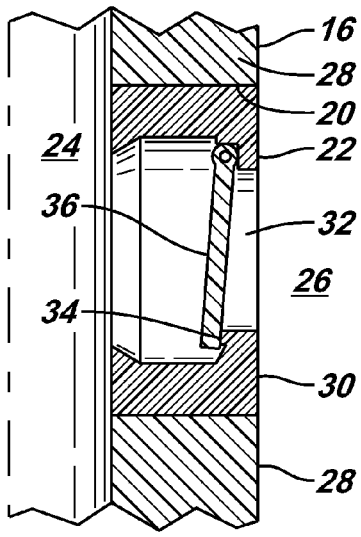
FIGS. 3-5 illustrates different types of one way valves mounted in the wall of a well conduit.

FIG. 4 illustrates another type of valve 22 that may be used in a well conduit wall 28 of the present invention. The valve 22 comprises a housing 30 defining a passageway therethrough and a valve seat 34. A flapper (valve member 36) allows flow in one direction through the valve 22, but prevents flow in an opposite direction. In FIG. 4, the valve 22 is oriented to allow flow into the conduit 16 and prevent flow from the conduit 16 (as in a production well 10).

Figure 5:
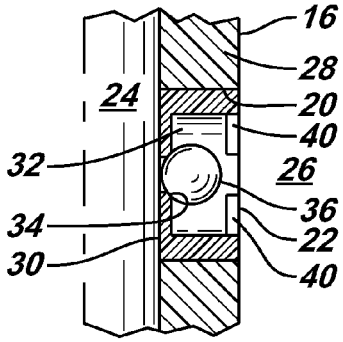

FIG. 5 shows a ball-type check valve 22 in a well conduit wall 28. In the closed position, the ball (valve member 36) seats on the valve seat 34 defined by a valve housing 30. The ball unseats in the open position and is supported on the ball supports 40 of the housing 30. The supports 40 are spaced to provide for flow around the ball when the ball is in the open position. The valve 22 in FIG. 5 is oriented to allow injection into a formation and prevent the inflow of fluids into the well conduit interior 24.

In some cases it may be advantageous to incorporate the valves 22 of the present invention into the base pipe 16 of a sand screen 42. As used herein, the term "screen" refers to wire wrapped screens, mechanical type screens and other filtering mechanisms typically employed with sand screens. Screens generally have a perforated base pipe 16 with a filter media (e.g., wire wrapping, mesh material, pre-packs, multiple layers, woven mesh, sintered mesh, foil material, wrap-around slotted sheet, wrap-around perforated sheet, mesh filter material, or a combination of any of these media to create a composite filter media and the like) disposed thereon to provide the necessary filtering. The filter media may be made in any known manner (e.g., laser cutting, water jet cutting and many other methods). Sand screens need to have openings small enough to restrict gravel flow or flow of material to be filtered, often having gaps in the 60 120 mesh range, but other sizes may be used. The screen element can be referred to as a screen, sand screen, or a gravel pack screen. Many of the common screen types include a spacer that offsets the screen member from a perforated base tubular, or base pipe 16, that the screen member surrounds. The spacer provides a fluid flow annulus between the screen member and the base tubular.

Figure 6:
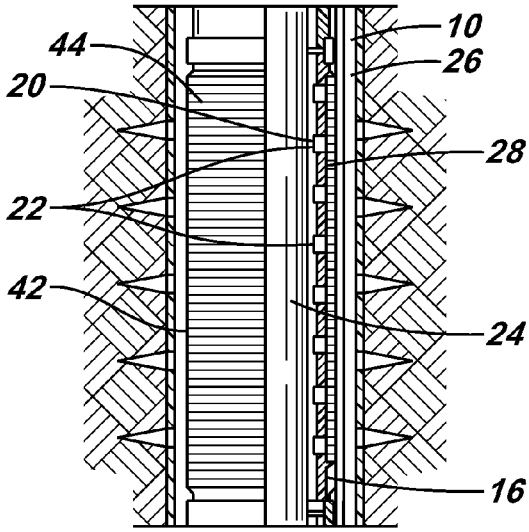
FIG. 6 illustrates a sand screen having one-way valves mounted in its base pipe.

FIG. 6 illustrates a sand screen 42 having a base pipe 16 and a filter media 44, which is shown as a wire wrap in the figure. The base pipe 16 has numerous openings through the base pipe wall 28. Valves 22 are mounted in the openings to control the flow into or from the screen 42. For example, in an injection well 10, the screen 42 with the check valves 22 in the base pipe wall 28 may be used to alleviate the sanding problems discussed above. Combining the check valves 22 with the screen 42 may enhance the desired effect of reducing sanding.

Likewise, the sand screen 42 shown in FIG. 6 may be used in a production well 10. The screen 42 allows fluid to be produced while preventing sand to enter the production conduit 16 and, at the same time, prevents fluid from exiting the production conduit 16.

Figure 7:
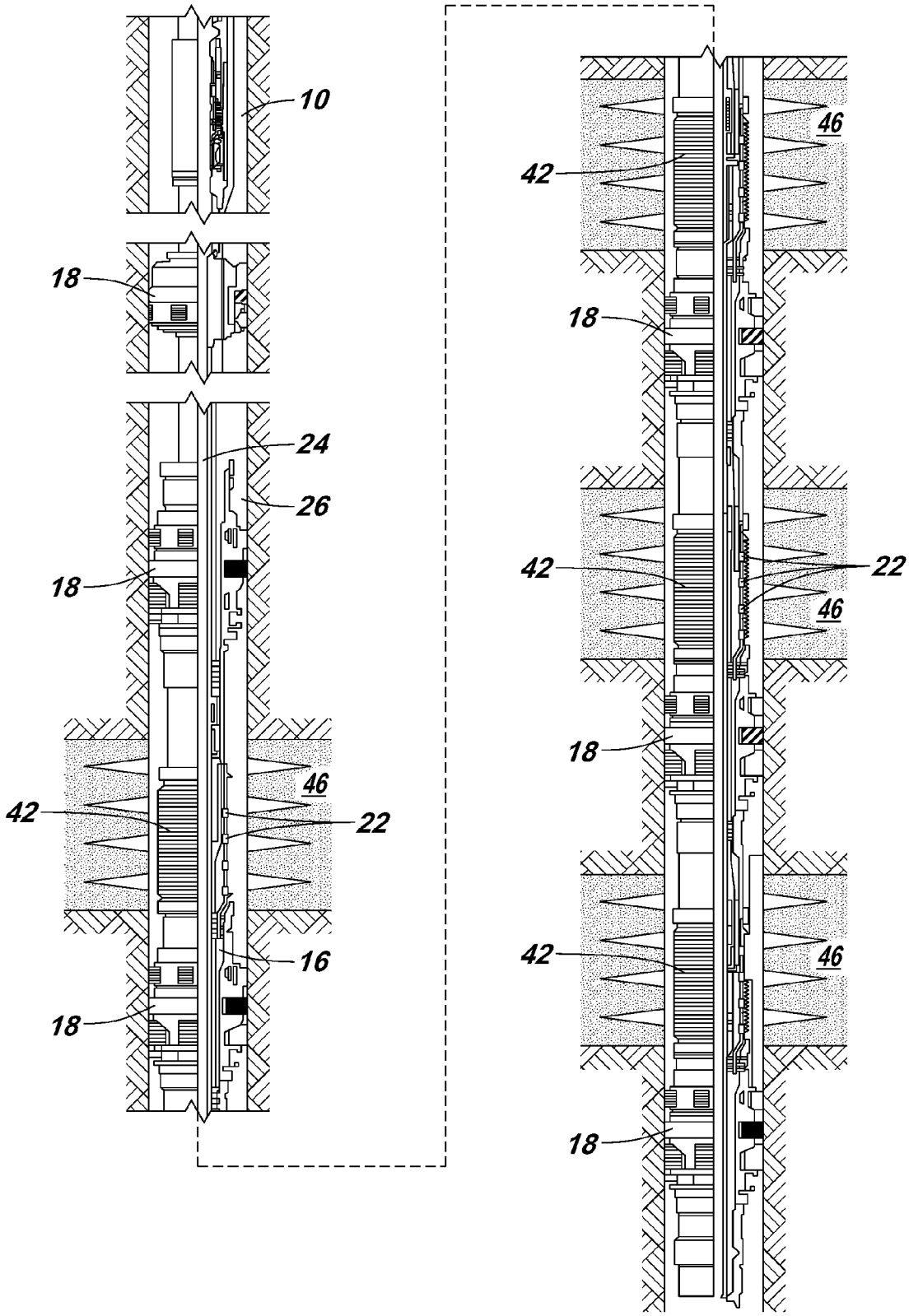
FIG. 7 shows the screen of FIG. 6 in a multizone well.

FIG. 7 illustrates one use of the sand screen 42 of FIG. 6 having the check valves 22 therein in a production well 10, although many other uses in production wells are possible. In this aspect of the invention, a production conduit 16 extending into the well 10 has at least one substantially radial aperture 20 and may have many apertures 20. A valve 22, such as a check valve or other valve described herein, is mounted within in at least a portion of the apertures 20. The valve 22 allows flow therethrough from an exterior 26 to an interior 24 of the production conduit 16, but limits flow therethrough from the interior 24 to the exterior 26. Thus, fluid is allowed into the production conduit 16, but flow out of the production conduit 16 is restricted or prevented.

As one example of a use of this aspect of the present invention, some production wells, such as the one shown in the figure, have multiple zones 46, which may include multilateral wells. One problem sometimes associated with multizone wells is cross-flow. Cross-flow may occur when the pressure in one zone 46 is different than the pressure in another zone 46. In this case, fluid may flow from the higher-pressure zone 46 into the lower-pressure zone 46 rather than to the surface. The present invention may alleviate this problem by limiting the flow of fluid from the production conduit 16 to a target reservoir 46 with a valve 22 mounted within at least a portion of the apertures 20. Some apertures 20 may remain open depending upon the application (e.g., if some flow into the formation is permissible). Thus, a sand screen 42 as described above in connection with FIG. 6, is provided in each of the zones 46 in FIG. 7. The production zones 46 are separated fluidically by packers 18. The check valves 22 in the sand screens 42 prevent cross-flow between the formations. Note that the screens 42 may be replaced by a conduit 16 having the check valves 22 therein (e.g., as shown in FIG. 2) in those cases where the sand control provided by the screens 42 is not necessary or desired.

Figure 8:
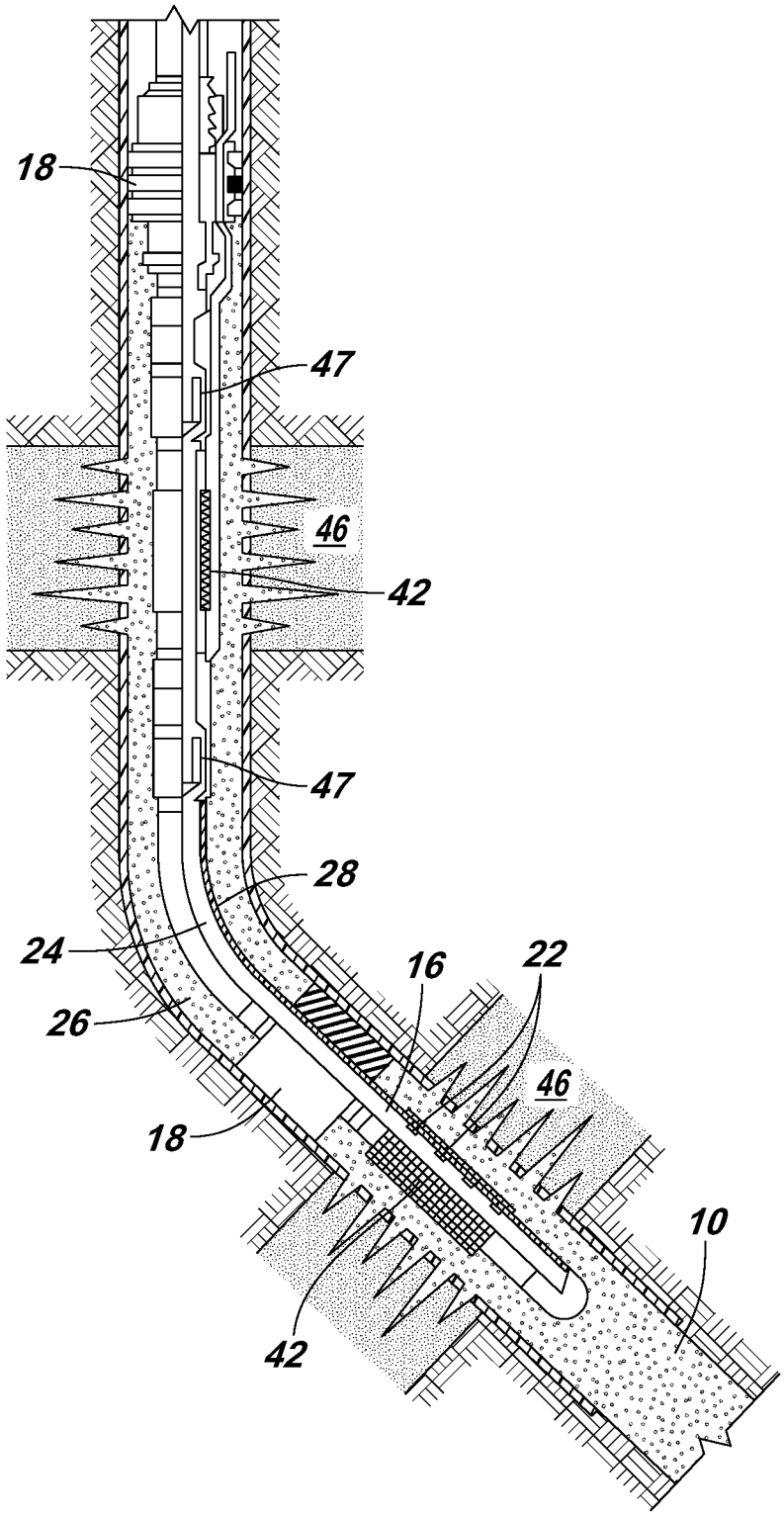
FIG. 8 illustrates a completion that has sand screen of FIG. 6 and in-line valves.

FIG. 8 illustrates another aspect of the current invention in which the conduit 16 having check valves 22 therein (which happen to be incorporated into sand screens 42 in FIG. 8) is combined with in-line flow control valves 47. The in-line flow control valves 47 may be used to regulate (e.g., choke) the flow to or from the various zones 46. See U.S. Patent Application Publication No. U.S. 2001/0045290 A1, published Nov. 28, 2001, for some examples of in-line valves 47.

Figure 9:
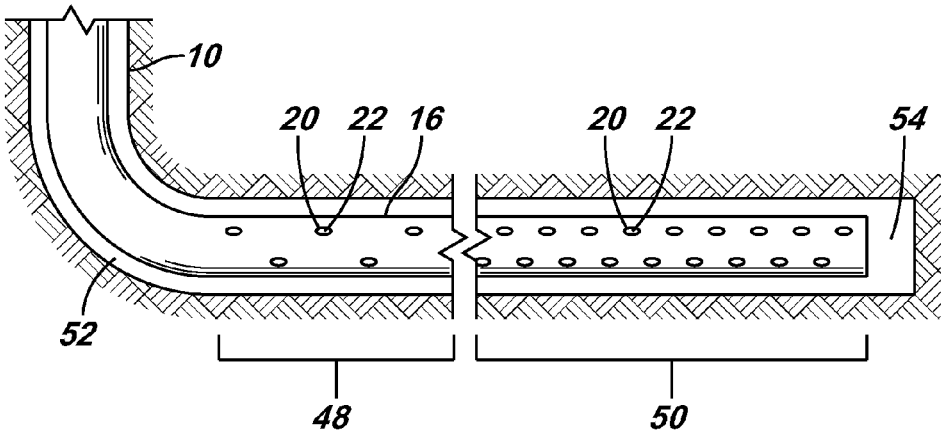
FIG. 9 shows a conduit with valves mounted in the walls of the conduit and having a varying density of valves along its length.

Another problem often associated with injection applications involves channeling. Uncontrolled injectivity can create channeling, which prevents sweep uniformity and can lead to early water production in the production well 10. As illustrated in FIG. 9, the present invention provides for variation in the density and concentration of valves 22 according to the well 10. Using data relating to the well(s) or reservoir, spacing between conduit apertures 20 is set to provide a uniform sweep of injected fluid. By varying the spacing between apertures 20 (and associated valves 22) in the conduit 16, the sweep of injected fluid into the well 10 and target reservoir 46 is controlled to alleviate the risk of channeling. In FIG. 9, the conduit 16 has one section 48 with a relatively lower concentration of openings and associated valves 22 and another section 50 with a relatively higher concentration of openings and associated valves 22. The relative concentration may vary depending upon the particular requirements and characteristics of the well 10. The varying of the concentration of the valves 22 also has application in a production environment or system. For example, in production wells it is often desirable to vary the flow of fluid produced along the length of the well 10 to reduce coning. Horizontal wells tend to produce faster from the heel 52 of the well 10 relative to the toe 54 of the well 10. Accordingly, it may be desirable to have a lower concentration of valves 22 near the heel 52 of the well 10 (as illustrated in FIG. 9) to reduce the rate of production at the heel 52.

Although only a few exemplary embodiments of this invention have been described in detail above, those skilled in the art will readily appreciate that many modifications are possible in the exemplary embodiments without materially departing from the novel teachings and advantages of this invention. For example, the valve 22 in each case described above may be designed to completely block flow when in the closed position or merely limit or restrict flow through the aperture 20. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

We claim:

1. A system for controlling fluid flow in a well, comprising:

a conduit extending into the well, having a plurality of radial apertures along the conduit's length wherein a concentration -of the apertures is varied along the axial length of conduit;

a valve mounted within each of the apertures adapted to limit flow through the aperture; and a filter media mounted to the conduit covering the apertures.

2. The system of claim 1, further comprising:

the conduit forming part of a completion string;

an in-line valve in the completion string.

3. The system of claim 1, further comprising:

one-way valves being mounted in at least a portion of the radial apertures.

4. The system of claim 1, further comprising:

the conduit forming part of a completion string;

a packer in the completion string;

the conduit extends on both sides of the packer and has a radial aperture on either side of the packer;

a one-way valve in at least one of the radial apertures limits flow from an interior of the conduit to an exterior of the conduit.

5. A well injection control device, comprising:

an injection conduit having a plurality of substantially radial apertures, wherein a concentration of the apertures is varied along an axial length of the conduit;

a check valve mounted within at least a portion of the apertures, the check valve is adapted to allow flow therethrough from an interior to an exterior of the injection conduit, but limit flow therethrough from the exterior to the interior; and a filter media mounted to the conduit covering the apertures.

6. A method for producing a fluid from a well, comprising:

providing a production conduit having a plurality of substantially radial apertures formed therein;

varying a concentration of the apertures along an axial length of the conduit;

producing the fluid through the plurality of substantially radial apertures;

filtering the fluid flowing through the apertures; and limiting the flow of fluid from the production conduit to a target reservoir with a check valve mounted within at least a portion of the apertures.

7. The method of claim 6, further comprising limiting cross-flow with the limiting the flow of fluid step.

8. The method of claim 6, further comprising limiting coning with the varying a concentration of the apertures step.

* * * * *